US007597327B2

(12) United States Patent
Dodge

(10) Patent No.: US 7,597,327 B2
(45) Date of Patent: Oct. 6, 2009

(54) METHOD FOR PLAYING DRAW POKER

(75) Inventor: Clifford B. Dodge, Billings, MT (US)

(73) Assignee: Gametech International, Inc., Reno, NV (US)

( * ) Notice: Subject to any disclaimer, the term of this patent is extended or adjusted under 35 U.S.C. 154(b) by 341 days.

(21) Appl. No.: 11/292,934

(22) Filed: Dec. 1, 2005

(65) Prior Publication Data

US 2007/0126180 A1 Jun. 7, 2007

(51) Int. Cl.
*A63F 1/00* (2006.01)

(52) U.S. Cl. ..... 273/292; 273/274; 273/303; 463/12

(58) Field of Classification Search ..... 463/13; 273/292

See application file for complete search history.

(56) References Cited

U.S. PATENT DOCUMENTS 5,732,950 A * 3/1998 Moody ..... 273/292
6,257,979 B1 * 7/2001 Walker et al. ..... 463/13
2002/0149153 A1 * 10/2002 Wichinsky ..... 273/292

* cited by examiner

*Primary Examiner*—Gene Kim
*Assistant Examiner*—Michael D Dennis
(74) *Attorney, Agent, or Firm*—Dillon & Yudell LLP

(57) ABSTRACT

An improved video draw poker game is disclosed wherein for each round of game play five hands of cards are sequentially dealt and played. Bets are placed on each hand, and the player selects some cards in each hand to be held, or to be rejected and replaced. Cards that are either held or rejected by a player in one hand of cards are moved forward to be played in a subsequent one of the five hands of cards to attempt to develop a better hand. The moved cards are replaced in the hand from which they are originally dealt.

3 Claims, 6 Drawing Sheets

| PAY TABLE | |
|---|---|
| Royal Flush | 800 |
| Straight Flush | 50 |
| 4 Of A Kind | 20 |
| Full House | 8 |
| Flush | 5 |
| Straight | 4 |
| 3 Of A Kind | 3 |
| Two Pair | 2 |
| Jacks Or Better | 1 |

METHOD FOR PLAYING DRAW POKER

FIELD OF THE INVENTION

The invention relates primarily to electronic video poker games, and more particularly to electronic video draw poker games.

BACKGROUND OF THE INVENTION

Electronic wagering games, such as video poker and video slot machines, are more successful, wherever they are played, when players are provided with a sense of participation and control, the opportunity to make decisions, reasonable odds of winning, and what the players perceive is an improved chance to beat the odds that are normally in favor of a casino.

Poker, in its many variations, is well known and is played using a standard deck of playing cards, and no standard poker hand contains more than five cards. In poker, various combinations of five cards from a standard fifty-two card deck have significance based on both the numerical or face value of the cards and their suits. The basic object of video poker is for a player to achieve a five card hand that yields game winnings per a pay table.

Poker is played in a number of variations including draw poker and stud poker. Probably the most common and popular poker variation is draw poker in which the player has the opportunity to substitute one or more of the cards they are initially dealt in an effort to improve the value of their hand.

The introduction of computerized, video poker games permits players to see the representation of dealt card hands on a video screen, and the players usually play against a standard payout table retained in the game computer memory. Conventional video draw poker is a single player game in which a player does not play against a dealer or other players, but rather tries to achieve the highest possible ranking poker hand. A payout schedule is used to determine the amount of winnings awarded to the player for achieving specified winning combinations of cards. After an initial deal of five cards, the player is allowed to hold cards, discard unwanted cards and draw replacement cards. The number of winning card combinations possible in a five card draw poker game means that, even at the lower payout value levels, a player has a relatively low probability of having a winning hand, even though lower ranked winning hands of cards are the ones which occur most frequently.

The conventional draw poker hand rankings that are used in video draw poker, from the highest to lowest, are: royal flush, straight flush, four of a kind, full house, flush, straight, three of a kind, two pair and a pair of jacks or better. Any hand having less than a pair of jacks or better is a losing hand. There is a wide difference in the winnings between a royal flush and a pair of jacks or better.

Over time gaming casino patrons become bored with standard versions of video poker games and casinos are continually looking for new variations of video poker games to continually create renewed interest and attract more players to play the games.

It would therefore be advantageous to have new video poker games which are similar to conventional games in their playing strategy but which provide for greater player interaction with the game and which would appear to provide greater opportunities for winning. Such new games would stimulate renewed interest of experienced players, and the interest of casual players, who will both find the new games exciting.

SUMMARY OF THE INVENTION

The present invention combines the most desirable elements of conventional draw poker played on video gaming machine with a novel improvement that gives a player more sense of participation and control, the opportunity to make decisions, reasonable odds of winning, and what the players perceive is a chance to beat odds that are normally in favor of a casino.

During each round of game play there are five hands of cards that are sequentially played. Bets are placed on each hand, some cards are held and other cards are rejected and replaced in each hand. Cards that are held in one hand of cards are carried forward to be played in a subsequent one of the five hands of cards to attempt to develop a better hand. The player thereby has a level of control during game play that makes the game challenging. For one example, a pair of kings held in one hand during a round of game play may be carried forward to the next and subsequent hands of cards to try to develop a better hand. For example, the player could hold and carry forward a pair of kings and during play of the next hand the player could end up with another king and two tens. This example end result can be achieved over two or more hands of cards by utilizing the ability to hold cards during play of one hand and using the same held cards in a later hand. This novel version of draw poker is called "Cascade Poker". At the end of play of the fifth hand, each of the five hands of cards is evaluated for winnings and the player can possibly achieve winnings in all five hands during the round of game play. In one example described in the Detailed Description the player achieves both a full house and a straight amongst the five hands of cards during one round of game play. Winnings are determined based on the number of bets per hand and from a pay table in a manner well known in the art.

In an alternative embodiment of the invention, instead of held cards from a hand of cards being carried forward to the next of the five hands of cards, non-held cards are carried forward to the next hand of cards. In a second example described in the Detailed Description, with this alternative embodiment the player achieves hands having two pair and jacks or better. Winnings are determined based on the number of bets per hand and from a pay table in a manner well known in the art.

With the present invention a player knows they can exercise their skill in determining which cards are to be held and which cards to be rejected to develop winning hands over the sequentially played five hands of cards.

DESCRIPTION OF THE DRAWINGS

The invention will be better understood upon reading the following Detailed Description in conjunction with the drawing in which.

DETAILED DESCRIPTION

Figures 1, 2:
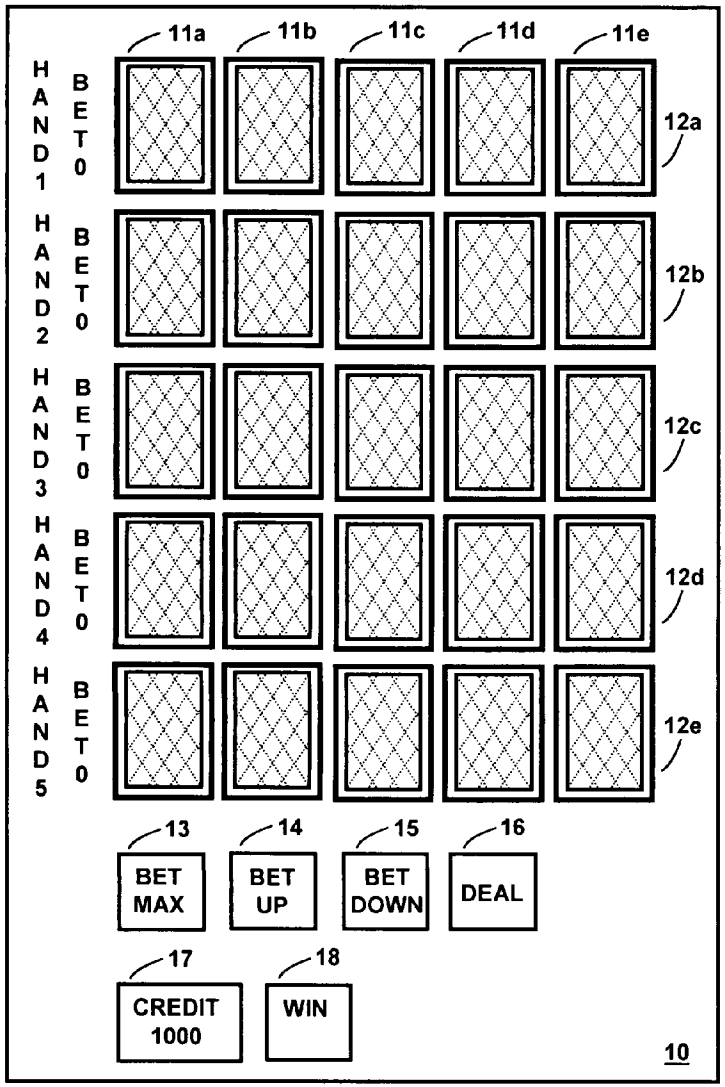
FIG. 1 shows the basic screen of a video draw poker game with card positions for five hands of cards for the novel Cascade Poker game.
FIG. 2 shows a pay table used in determining winnings when playing the Cascade Poker game.

The present invention combines the most desirable features of draw poker with a novel improvement that gives a player more sense of participation and control, reasonable odds of winning, and what the players perceive is a chance to beat odds that are normally in favor of casino. This desirable draw poker game is called "Cascade Poker".

For Cascade Poker the improvement is achieved with a round of game play comprising sequentially playing five hands of cards with cards from one hand being carried forward to and used in the subsequent hand of cards based on selections made by the player for the previous hand of cards. Alike conventional draw poker each hand of cards comprises five cards that are initially dealt and the player selects cards. Also, prior to game play bets are placed on each of the five hands hand.

During each round of game play, for each of the five hands of cards some cards are held and other cards are rejected. In a first, preferred embodiment of the invention cards that are held in a hand of cards are carried forward to be played in the next of the five hands of cards to attempt to develop a better hand. Once the held cards are moved from a first hand to a second hand they are replaced with newly dealt cards in the first hand. Non-held cards in the first hand are not replaced and are used to complete the first hand. This sequence is repeated for all but the last hand of cards because there is no subsequent hand of cards to which to move held cards. While the step of dealing of cards and the step of replacement of held cards that are being moved forward to a subsequent hand are described in a specific order herein, the order is not important.

The player has a level of control during game play that makes the cascade draw poker game challenging. For one example, a pair of kings held in one hand during a round of game play may be carried forward to the next hand to try to develop a better subsequent hand. During play of the subsequent hand the player could be dealt another king and two tens for a winning hand. This end result can be achieved over two or more hands of cards by utilizing the ability to hold cards during play of one hand and using the same held cards in one or more subsequent hands. At the end of play of the fifth hand of cards, each of the five hands of cards is evaluated for winnings and the player can conceivably achieve winnings for each of the five hands during a single round of game play. In one example, described in detail hereinafter with reference to FIGS. 3-7, the player achieves a full house and a straight amongst the five hands of cards during the round of game play. Winnings are determined based on the number of bets per hand and from a pay table in a manner well known in the art.

In an alternative embodiment of the invention, one example of which is described below with reference to FIGS. 8-12, instead of held cards from each hand of cards being carried forward to the next of the five hands of cards, non-held cards are carried forward to the next hand of cards and replaced in the original hand of cards. In the example of the alternative embodiment of the invention described hereinafter with reference to FIGS. 8-12 the player achieves two pair and jacks or better. Winnings are determined based on the number of bets per hand and from a pay table in a manner well known in the art. While the step of dealing of cards and the step of replacement of non-held cards that are being moved forward to a subsequent hand are described in a specific order herein, the order is not important.

In FIG. 1 is shown a display screen 10 of a computer controlled video implementation of the novel Cascade Poker game in accordance with the teaching of the present invention. Some standard features of a poker gaming machine video display that are well known in the art are deliberately not shown in FIG. 1 and the other figures to avoid detracting from the teaching of the present invention and to avoid cluttering the drawing.

Typically there is a slot for inserting coins or tokens to place a number of wagers or bets for a round of game play. In addition, there may be a slot for the insertion of a debit card from which the game debits the number of wagers or bets placed by a player, and to which the game credits any winnings. Such wagers or bets from a debit card are often referred to as credits and this is the term used throughout the detailed description. Also, when there is a slot for insertion of coins or tokens there will be a tray into which winnings in the form of coins or tokens are dispensed. In addition, if there is a slot for inserting a debit card to bet on a round of game play that same slot is used to credit winnings to the debit card. The video screen display may include information such as, but not limited to, copyright and trademark notices, manufacturer of equipment, name of game, and fancy graphics. There may be a flashing light on the top of the game housing to announce a winning jackpot; and there may be other controls. Also included on the front panel of the game housing, or on a first display screen, there may be game instructions for a player as to how to play the Cascade Poker game and preferably instructions on the video display screen 10 indicating what action is required by the player at particular times during game play. The Cascade Poker game instructions may also be called up and displayed by touching an on-screen button or off-screen button (neither of which is shown). These other elements form no specific part of the present invention.

In FIG. 1 there are shown five rows (12*a*-12*e*) of five card display positions 11*a*-11*e* in which cards are sequentially dealt to play the novel version of draw poker taught herein. The five card positions in each row are designated in this detailed description and in the drawing as Hand 1 through Hand 5. These designations are displayed on the video screen to the left of each hand as shown. A separate deck of cards is used to deal each of Hands 1-5 in the description herein.

Also shown to left of each of the rows (Hand 1-5) is the number of bets placed on each hand. In the first embodiment of the invention shown in FIGS. 3-7 two bets are placed on each hand as shown in those figures. In the second, alternative embodiment of the invention shown in FIGS. 8-12 five bets are placed on each hand as shown in those figures.

In FIG. 1 is shown four buttons. They are a Bet Max button 13 which a player will touch to indicate the maximum possible number of bets is to be bet for a round of game play. There is a Bet Up button 14 that a player will touch to incrementally increase their bets prior to the start of game play. There is a Bet Down button 15 that a player will touch to incrementally decrease their bets prior to the start of game play. There is also a Deal button 16 that a player touches to commence Match Poker game play after they have placed their bets. In FIGS. 4-12 is shown Draw button 19. Other commonly known buttons are not shown because they are well known in the prior art, do not need to be described herein to fully understand the teaching of the present invention, and to avoid detracting from the description of the invention. In FIG. 1 only the backs of cards are shown in all twenty-five card positions because a player has not yet used buttons 13 through 15 to place bets and then touched Deal button 16.

Figure 7:
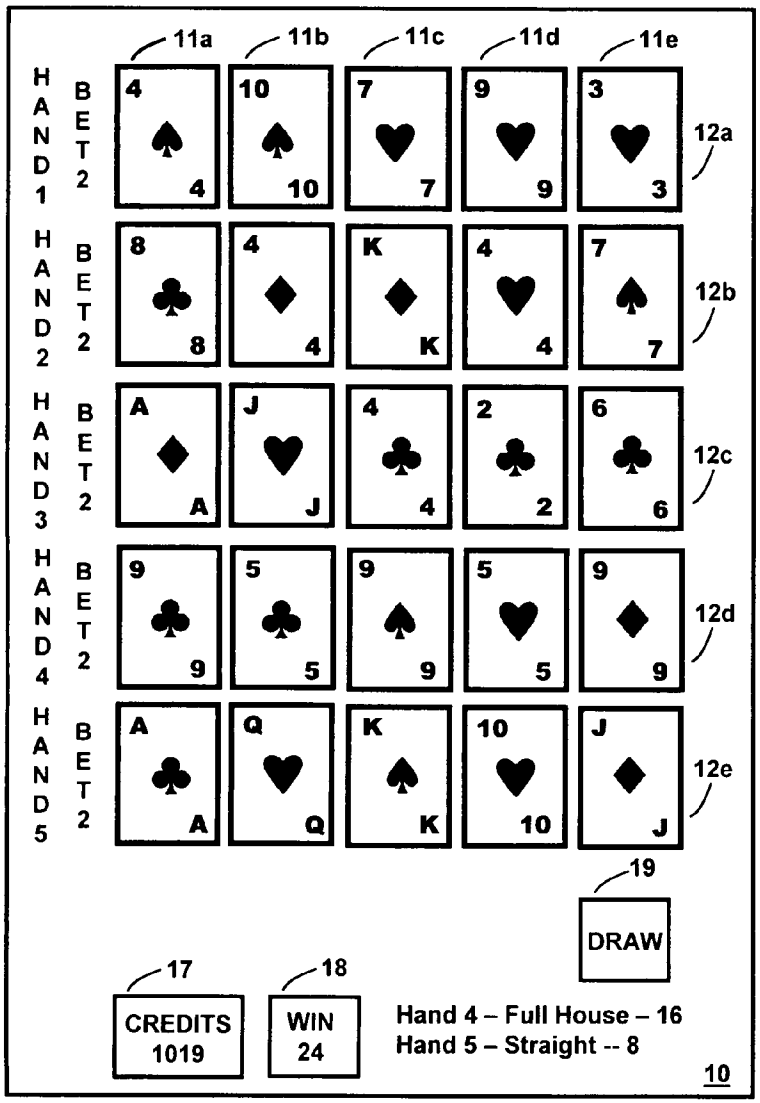
FIG. 7 shows a fifth hand of the five hands of cards dealt during the first round of game play in which the held cards from the fourth hand are carried forward to the fifth hand of cards and with other dealt cards achieve the final hand of cards for the fifth hand, and the held cards that were in the fourth hand are replaced to achieve the final hand of cards for the fourth hand.
Figure 12:
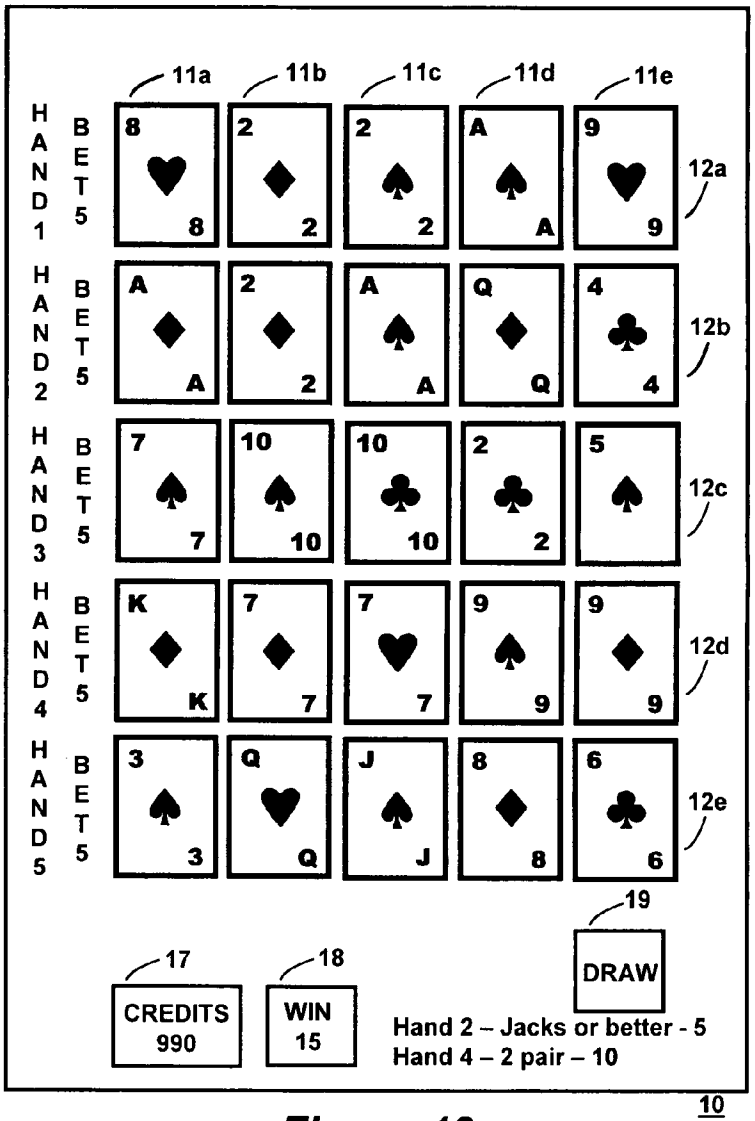
FIG. 12 shows a fifth hand of the five hands of cards dealt during the round of game play of the alternative embodiment of the invention in which the non-held cards from the fourth hand are carried forward to the fifth hand of cards to achieve the final hand of cards for the fifth hand, and the non-held cards that were in the fourth hand are replaced to achieve the final hand of cards for the fifth hand.

There is also an on-screen display area 17 showing the number of credits a player has to play, and an on-screen display area 18 showing the total winnings a player has achieved, if any, for a round of game play. At the end of each round of game play there is also an on-screen display of the winning hands and what they are as shown in FIGS. 7 and 12. Initially the player is assigned 1,000 credits for game play and this number shown in display position 17 in FIG. 1.

In FIG. 2 is shown a pay table that is used in determining winnings when playing Cascade Poker. Such pay tables are well known in the art so FIG. 2 is not described any further. The pay table may be displayed to a player on screen or on the cabinet in which the video game is mounted.

Figure 3:
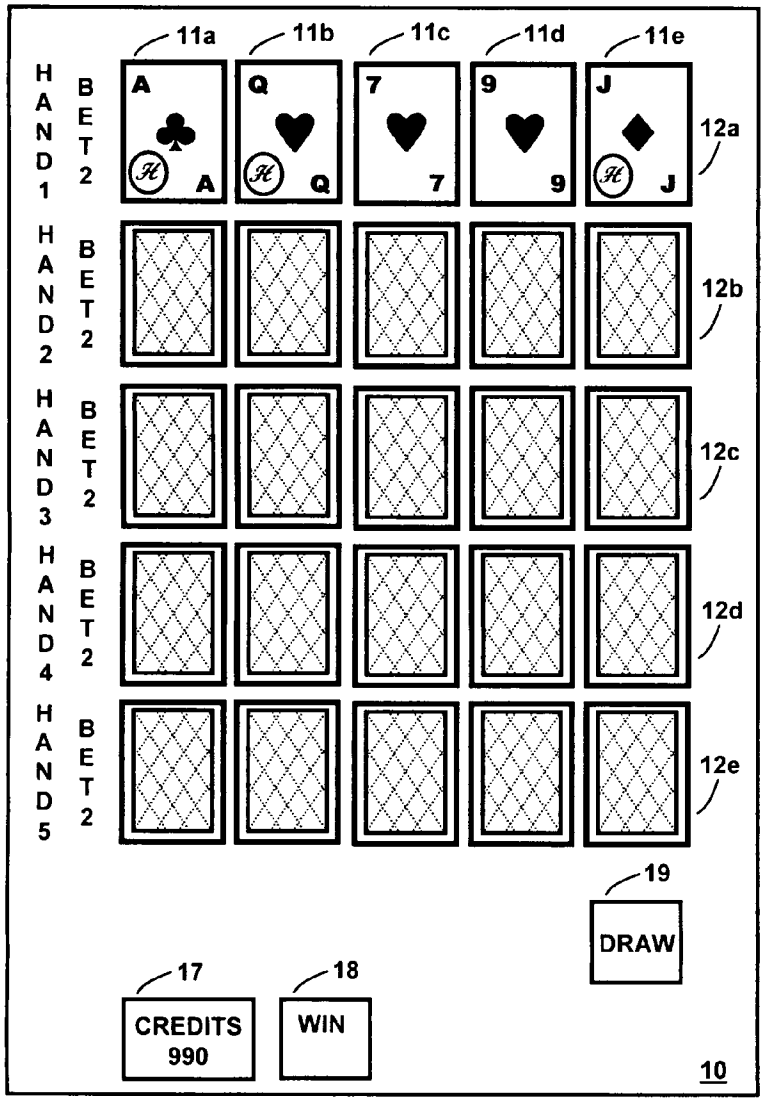
FIG. 3 shows a first hand of the five hands of cards dealt during a first round of game play of Cascade Poker and shows cards held in the first hand.

Initially a player places their bets using buttons 13-15. The number of bets are displayed next to the ones of Hand 1 through Hand 5 as shown. For the round of game play of the first embodiment of the invention the player has placed two bets on each of Hand 1-Hand 5 as indicated in FIG. 3 adjacent to each hand as "Bet 2". The first time the player touches Bet Up button 14 the indication Bet 1 appears next to each hand. The second time the player touches Bet Up button 14 the indication Bet 2 appears next to each hand. This sequence repeats until the maximum number of bets is chosen. The player may alternatively select the maximum number of bets for all five hands by touching on screen Bet Max button 13. The player may change their mind and decrease their bets by touching Bet Down button 15.

Following placement of bets the player touches on-screen Deal button 19 in FIG. 1, and the display changes to that shown in FIG. 3 with the display of the first of the five hands of cards for a first round of game play of Cascade Poker in accordance with the teaching of the invention. In this embodiment cards which are held are carried forward to subsequent hands during the course of game play and are replaced in the present hand. This will be better understood in reading the following description.

The player studies the first hand and elects to hold the ace of clubs, queen of hearts and jack of diamonds. The player selects these three cards by touching them on video display screen 10 which is equipped with touch screen technology that is well known in the art. Responsive to being touched the letter "*H*" in a circle is displayed on the ace of clubs, queen of hearts and jack of diamonds indicating that these cards are being held. The player may change their mind and retouch any of these three cards to remove the held status, and then touch other cards to be held. The player may touch none or all of the five cards in Hand 1.

Figure 4:
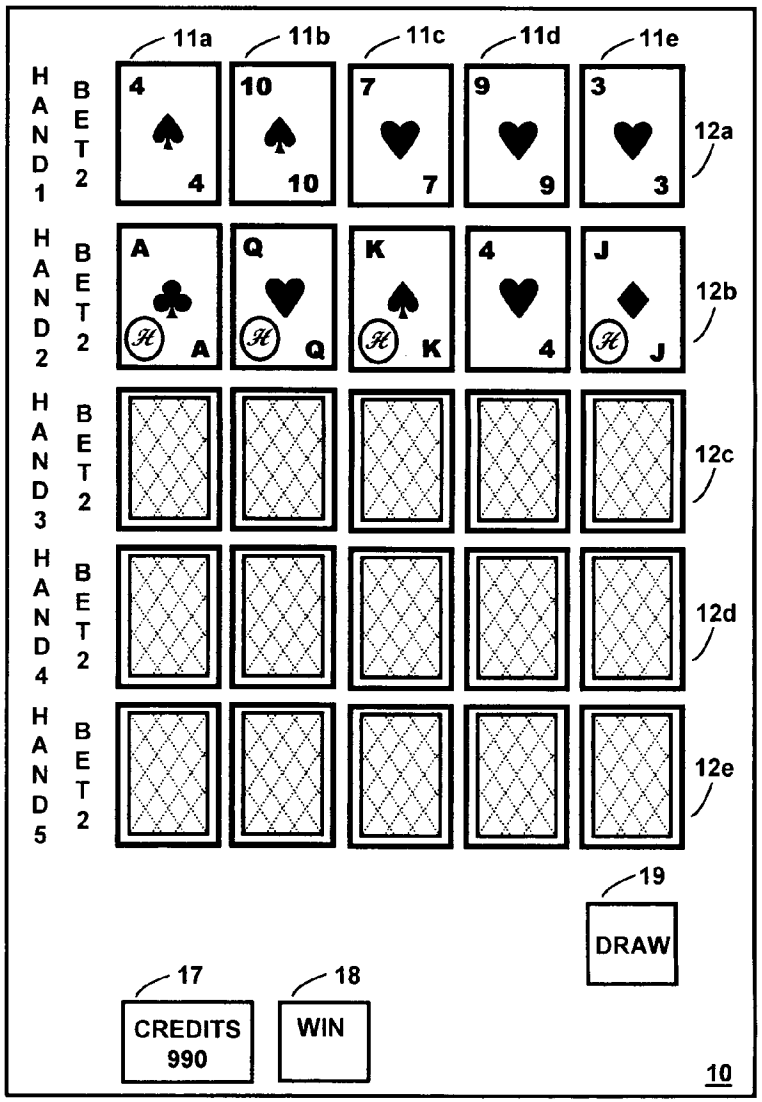
FIG. 4 shows a second hand of the five hands of cards dealt during the first round of game play in which the held cards from the first hand are carried forward to the second hand of cards, the held cards that were in the first hand are replaced to achieve the final hand of cards for the first hand, and cards in the second hand are held or rejected.

After cards in Hand 1 are selected to be held the player touches Draw button 19 which is now displayed on video display screen 10. Buttons 13 through 16 have been removed from the display because they are not needed hereinafter during a round of game play. Responsive to Draw button 19 being touched Hand 2 cards are dealt as shown in FIG. 4. It should be noted that in accordance with the teaching of the invention the held ace of clubs, queen of hearts and jack of diamonds slide down and are displayed in the same positions in Hand 2. Two new cards are drawn and displayed in the third and fourth positions in Hand 2. These new cards are the king of spades and the four hearts. With the three held cards being moved from Hand 1 to Hand 2 they must be replaced in Hand 1. In Hand 1 the four of spades replaces the ace of clubs, the ten of diamonds replaces the queen of diamonds, and the three of hearts replaces the jack of diamonds. The non-held cards in Hand 1, the seven of hearts and the nine of hearts remain in Hand 1 as shown. This is the final set of cards for Hand 1 and it is displayed as Hand 1 in FIGS. 4 through 7. This final Hand 1, which comprises the four of spades, ten of spades, seven the hearts, nine of hearts and three of hearts will be evaluated for any winnings at the end of the round of game play.

The player must now select what cards in Hand 2, if any, are to be held. As shown in FIG. 4 the player has elected to continue to hold the ace of clubs, queen of hearts, and jack of diamonds and touches these three cards. In addition, one of the newly dealt cards in Hand 2 is the king of spades in card position three and the player elects to hold this card as well, hoping for a straight. As the player touches each of these four cards the letter "*H*" in a circle is displayed on each card indicating that it is being held.

Figure 5:
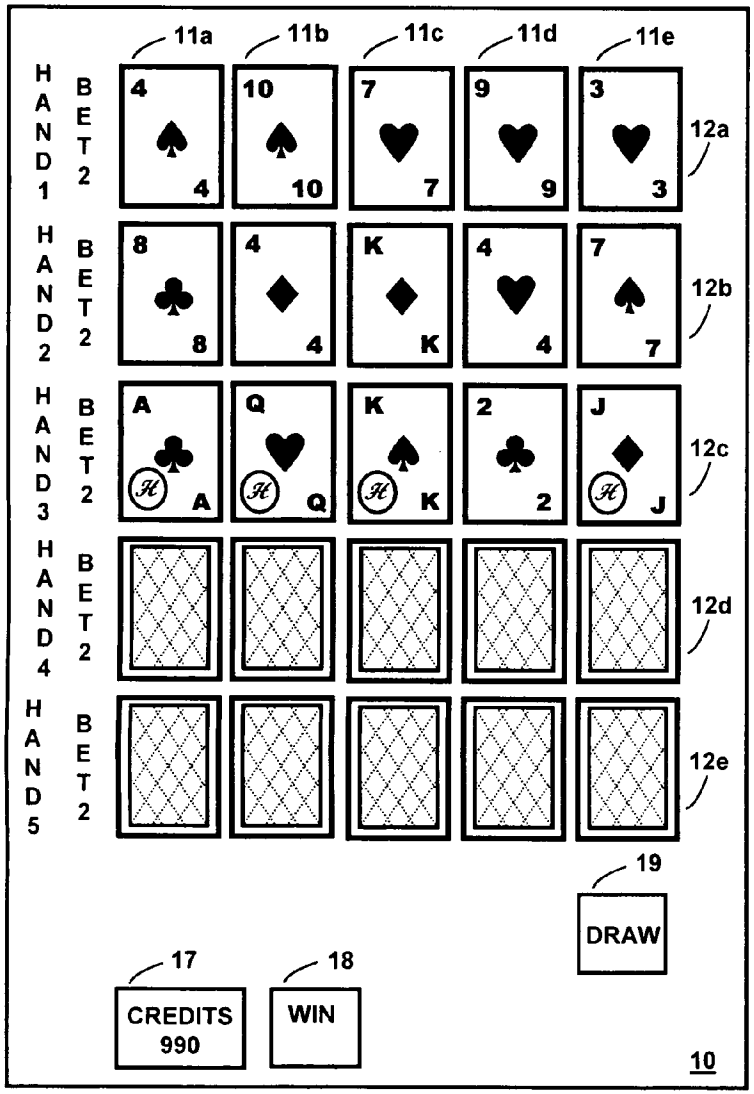
FIG. 5 shows a third hand of the five hands of cards dealt during the first round of game play in which the held cards from the second hand are carried forward to the third hand of cards, the held cards that were in the second hand are replaced to achieve the final hand of cards for the second hand, and cards in the third hand are held or rejected.

After the cards in Hand 2 are selected to be held that the player again touches Draw button 19. Responsive thereto Hand 3 cards are dealt as shown in FIG. 5. In accordance with the teaching of the invention the Hand 2 held cards, the ace of clubs, queen of hearts, king of spades and jack of diamonds slide down and are displayed in the same relative positions in Hand 3. One new card, the two of clubs, is drawn and displayed in the fourth position of Hand 3 as shown. With the four held cards moving from Hand 2 to Hand 3 they must be replaced in Hand 2. The eight of clubs replaces the ace of clubs, the four of diamonds replaces the queen of hearts, the king of diamonds replaces the king of spades, and the seven of spades replaces the jack of diamonds. The non-held card in Hand 2, the four of hearts, remains in that hand as shown. This is the final set of cards for Hand 2 and it is displayed as Hand 2 in FIGS. 5 through 7. This final Hand 2 comprises the eight of clubs, four of diamonds, king of diamonds, four of hearts and seven of spades and will be evaluated for any winnings at the end of the round of game play.

The player must now select what cards in Hand 3, if any, are to be held. As shown in FIG. 5 the player has elected to continue to hold the ace of clubs, queen of hearts, king of spades and jack of diamonds and touches these four cards. As the player touches each of these four cards the letter "$\mathcal{H}$" in a circle is displayed on each card indicating it is being held. In addition, the newly dealt card in Hand 4 is the five of hearts.

Figure 6:
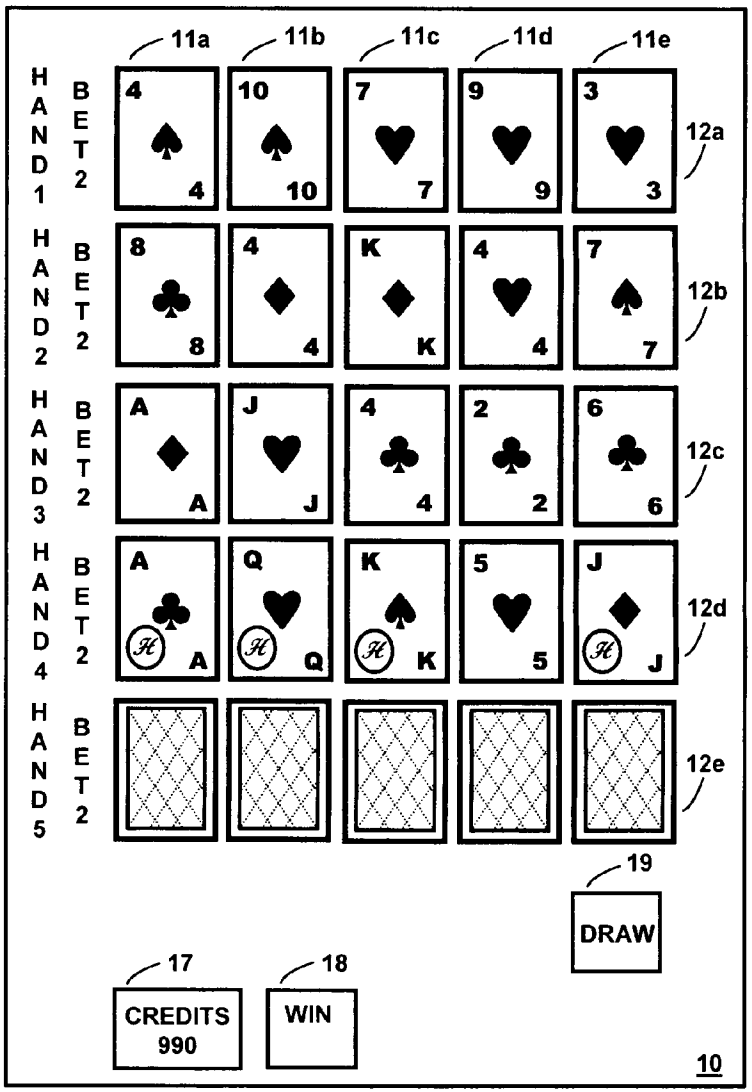
FIG. 6 shows a fourth hand of the five hands of cards dealt during the first round of game play in which the held cards from the third hand are carried forward to the fourth hand of cards, the held cards that were in the third hand are replaced to achieve the final hand of cards for the third hand, and cards in the fourth hand are held or rejected.

After the cards in Hand 3 are selected to be held the player touches Deal button 19. Responsive thereto Hand 4 cards are dealt as shown in FIG. 6. In accordance with the teaching of the invention the Hand 3 held cards, the ace of clubs, queen of hearts, king of spades and jack of diamonds slide down and are displayed in the same relative positions in Hand 4. One new card, the five of hearts, is dealt and displayed in the fourth position of Hand 4 as shown. With the four held cards moving from Hand 3 to Hand 4 they must be replaced in Hand 3. The ace of diamonds replaces the ace of clubs, the jack of hearts replaces the queen of hearts, the four of clubs replaces the king of spades, and the six of clubs replaces the jack of diamonds. The non-held card in Hand 3, the two of clubs, remains in Hand 3 as shown. This is the final set of cards for Hand 3 and it is displayed as Hand 2 in FIGS. 6 and 7. This final Hand 3, which comprises the ace of diamonds, jack of hearts, four of clubs, two of clubs and six of clubs will be evaluated for any winnings at the end of the round of game play.

The player must now select what cards in Hand 4, if any, are to be held. As shown in FIG. 6 the player has again elected to hold the ace of clubs, queen of hearts, king of spades and jack of diamonds and touches these four cards. As the player touches each of these four cards the letter "$\mathcal{H}$" in a circle is displayed on each card indicating it is being held. The player again touches Draw button 19. Responsive thereto Hand 5 cards are dealt as shown in FIG. 7. It should be noted that the Hand 4 held cards, the ace of clubs, queen of hearts, king of spades and jack of diamonds slide down and are displayed in the same relative positions in Hand 5. One new card, the ten of hearts, is drawn and displayed in the fourth position of Hand 5 as shown. With the four held cards moving from Hand 4 to Hand 5 they must be replaced in Hand 4. The nine of clubs replaces the ace of clubs, the five of clubs replaces the queen of hearts, the nine of hearts replaces the king of spades, and the nine of diamonds replaces the jack of diamonds. The non-held card in Hand 4, the five of hearts, remains in Hand 4 as shown. This is the final set of cards for Hand 4 and it is displayed as Hand 4 in FIG. 7. This final Hand 4, which comprises the nine of clubs, five of clubs, nine of spades, five of hearts and nine of diamonds will be evaluated for any winnings at the end of the round of game play.

The newly dealt card in Hand 5 is the ten of hearts. The player does not select any cards in Hand 5 to be held because there is no Hand 6. Thus, the five cards shown in Hand 5 in FIG. 7 is the final set of cards for Hand 5 and comprises the ace of clubs, queen of hearts, king of spades, 10 of hearts and jack of diamonds.

With the play of all five hands of the first round of game play for the preferred embodiment of the invention being completed the game program determines the winning hands amongst Hand 1 through Hand 5. As may be seen in FIG. 7 Hand 4 is a full house comprising three nines and two fives, and Hand 5 is a straight. These winning hands are indicated at the bottom of video display screen 10 along with the player's winnings which are based upon the pay table showing FIG. 2 and the number of bets placed on the five hands of cards. In FIG. 2 a full house wins eight credits and, with two bets being placed on each hand, the player wins 16 credits as indicated. In FIG. 2 a straight wins four credits and, with two bets being placed on each hand, the player wins eight credits as indicated. Thus, the player wins a total of 24 credits as indicated in Win display area 18. In the Credits display area 17 the remaining 990 credits is incremented by the 24 credits won by the player to a new total of 1019 credits.

Figure 8:
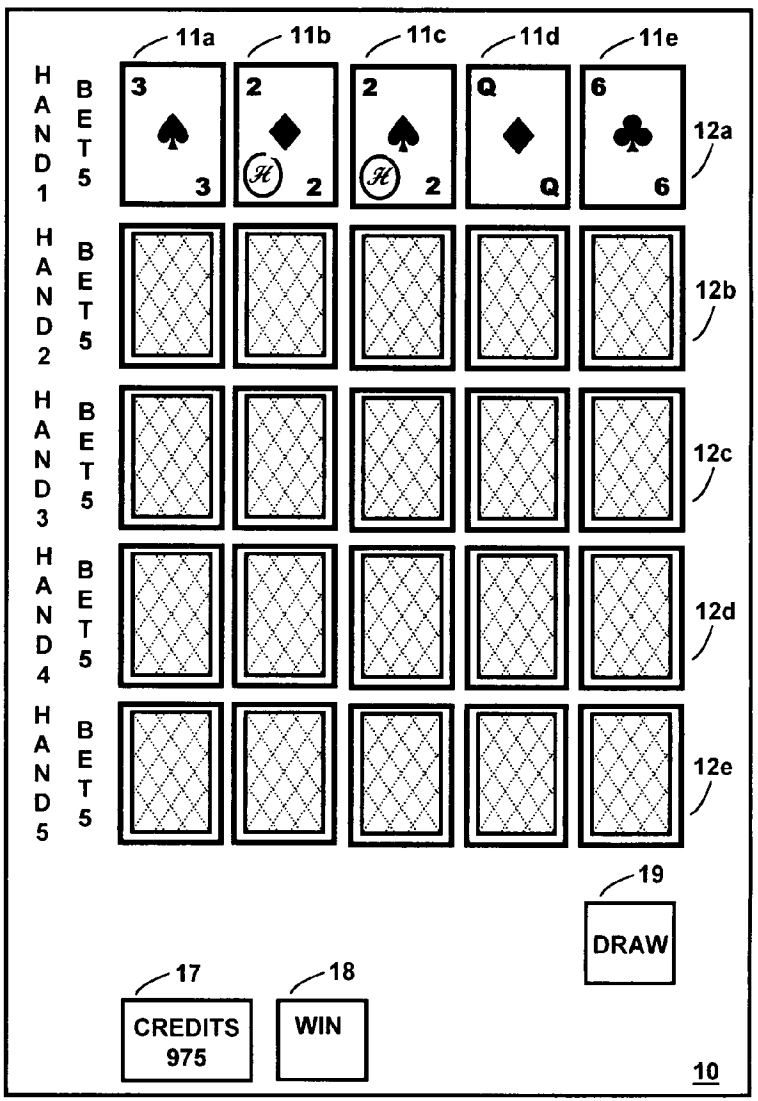
FIG. 8 shows a first hand of five hands dealt during a round of game play of Cascade Poker that is an alternative embodiment of the invention, and shows cards held in the first hand.

FIGS. 8 through 12 show an example of a round of game play for the alternative embodiment of the invention. In the alternative embodiment of the novel cascade draw poker game, instead of held cards from each hand of cards being carried forward to the next of the five hands of cards, non-held cards are carried forward to the next hand of cards. It is assumed that this round of game play starts at FIG. 1 with the player having 1000 credits to play and placing debts. In this example the player touches on-screen button Bet Up 14 five times to place five bets on each of Hand 1 through Hand 5. This is shown in FIG. 8 as Bet 5 adjacent to each of Hand 1 through Hand 5. Correspondingly, the player's remaining credits are decremented up from 1019 to 975 credits as shown in FIG. 8. As previously described, a player may decrease their number of bets using on-screen button Bet Down 16, and select the maximum number of bets by touching on-screen button Bet Max 13.

Following placement of bets the player touches on-screen Deal button 19 in FIG. 1, and the display changes to that shown in FIG. 8 with the display of the first of the five hands of cards for a round of game play of Cascade Poker in accordance with the alternative embodiment of the invention. In the alternative embodiment cards which are not held are carried forward to a subsequent hand during the course of game play and are replaced in the present hand.

The player studies the first hand and elects to hold the two of diamonds and two of spades. The player selects these two cards by touching them on display screen 10 which is equipped with touch screen technology. Responsive to being touched the letter "$\mathcal{H}$" in a circle is displayed on the two of diamonds and the two of spades indicating that these cards are being held. The player may change their mind and retouch either of these two cards to remove the held status, and then touch other cards to be held. The player may touch none or all of the five cards in Hand 1 shown in FIG. 8.

Figure 9:
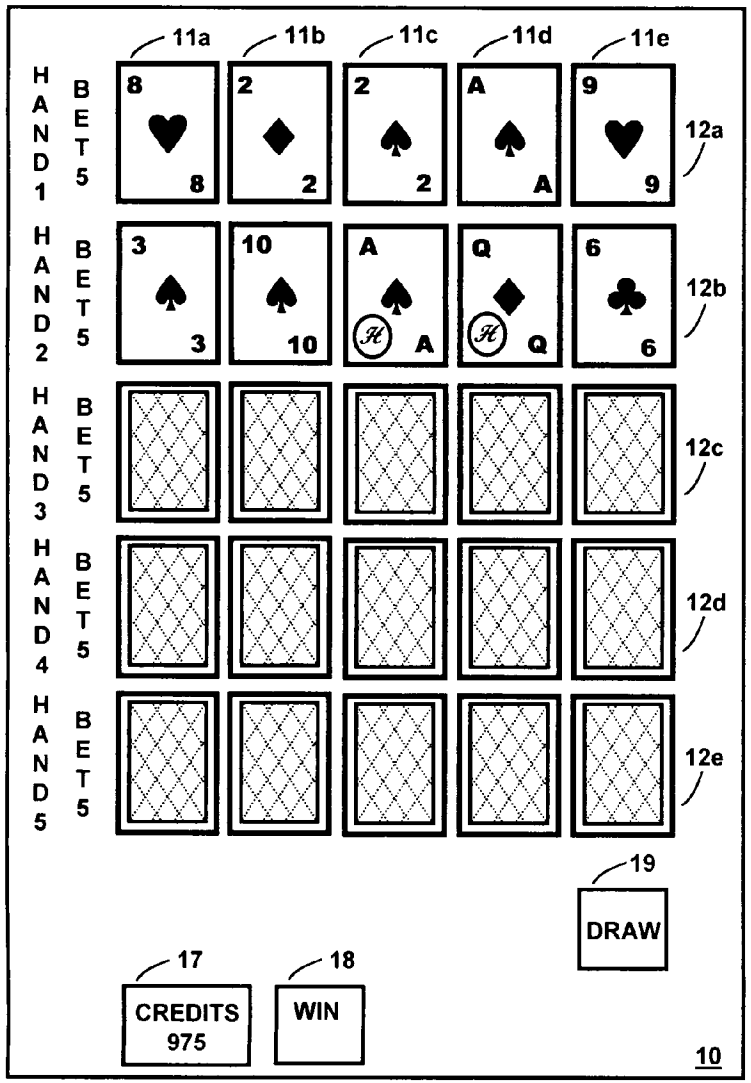
FIG. 9 shows a second hand of the five hands of cards dealt during the round of game play of the alternative embodiment of the invention in which non-held cards from the first hand are carried forward to the second hand of cards, the non-held cards that were in the first hand are replaced to achieve the final hand of cards for the first hand, and cards in the second hand are held or rejected.

After the cards in Hand 1 are selected to be held the player touches Draw button 19 which is now displayed on video touch screen 10 in FIG. 8. Buttons 13 through 16 have been removed from the display because they are not needed during game play at this point in game play. Responsive to Draw button 19 being touched Hand 2 cards are dealt as shown in FIG. 9. In accordance with the teaching of the invention for the alternative embodiment of the invention the held two of diamonds and two of hearts remain in Hand 1 and the non-held three of spades, queen of diamonds and six of clubs slide down and are displayed in the same positions in Hand 2 as shown in FIG. 9. Two new cards are drawn and displayed in the second and third of the five card positions in Hand 2. These are the 10 of spades and the ace of spades. With the three non-held cards moving from Hand 1 to Hand 2 they must be replaced in Hand 1. The eight of hearts replaces the three of spades, the ace of spades replaces the queen of diamonds, and the nine of hearts replaces the six of clubs. The held cards in Hand 1, the two of diamonds and the two of spades remain in Hand 1 as shown. This is the final set of cards for Hand 1 and it is displayed as Hand 1 in FIGS. 9 through 12. This final Hand 1, which comprises the eight of hearts, two of diamonds, two of spades, ace of space and nine of hearts will be evaluated for any winnings at the end of the round of game play.

The player must now select what cards in Hand 2, if any, are to be held. As shown in FIG. 9 the player has elected to hold the ace of spades and queen of diamonds and touches these two cards. As the player touches each of these two cards the letter "*H*" in a circle is displayed on each card indicating that it is being held. As previously described the player may change their mind and deselect either or both of the two cards and select other cards to be held.

Figure 10:
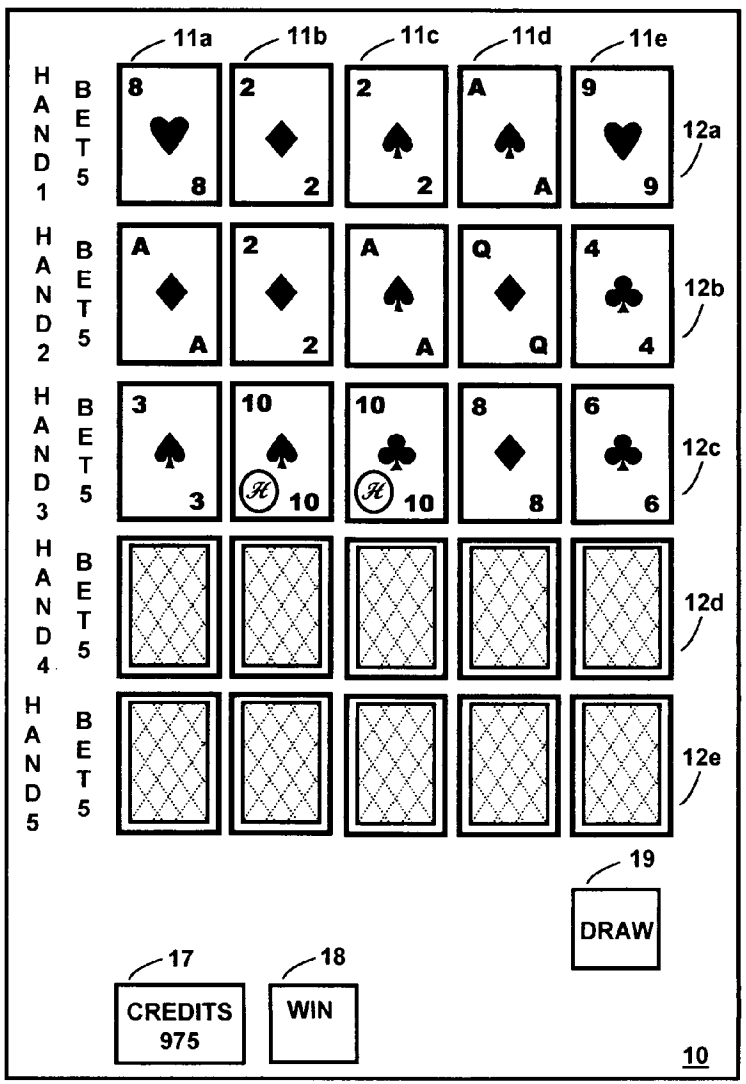
FIG. 10 shows a third hand of the five hands of cards dealt during the round of game play of the alternative embodiment of the invention in which the non-held cards from the second hand are carried forward to the third hand of cards, the non-held cards that were in the second hand are replaced to achieve the final hand of cards for the second hand, and cards in the third hand are held or rejected.

After the two cards in Hand 2 are selected to be held the player touches Draw button 19. Responsive thereto Hand 3 cards are dealt and the game video display is as shown in FIG. 10. It should be noted that the Hand 2 non-held cards, the three of spades, ten of spades and six of clubs slide down and are displayed in the same relative positions in Hand 3. Two new cards, the ten of clubs and the eight of diamonds, are drawn and displayed in the third and fourth positions of Hand 3 as shown. With the three non-held cards moving from Hand 2 to Hand 3 they must be replaced in Hand 2. The ace of diamonds replaces the three of spades, the two of diamonds replaces the ten of spades, and the four of clubs replaces the six of clubs. The held ace of spades and queen of diamonds remain in the Hand 2 as shown. The final set of cards for Hand 2 is displayed in FIGS. 10 through 12. This final Hand 2, which comprises the ace of diamonds, two of diamonds, ace of spades, queen of diamonds and four of clubs, will be evaluated for any winnings at the end of the round of game play.

The newly dealt cards in Hand 3 are the ten of clubs and the eight of diamonds. The player must now select what cards in Hand 3, if any, are to be held. As shown in FIG. 10 the player elects to hold the ten of spades and ten of clubs and touches these two cards to hold them. As the player touches each of these four cards the letter "*H*" in a circle is displayed on each card indicating it is being held.

Figure 11:
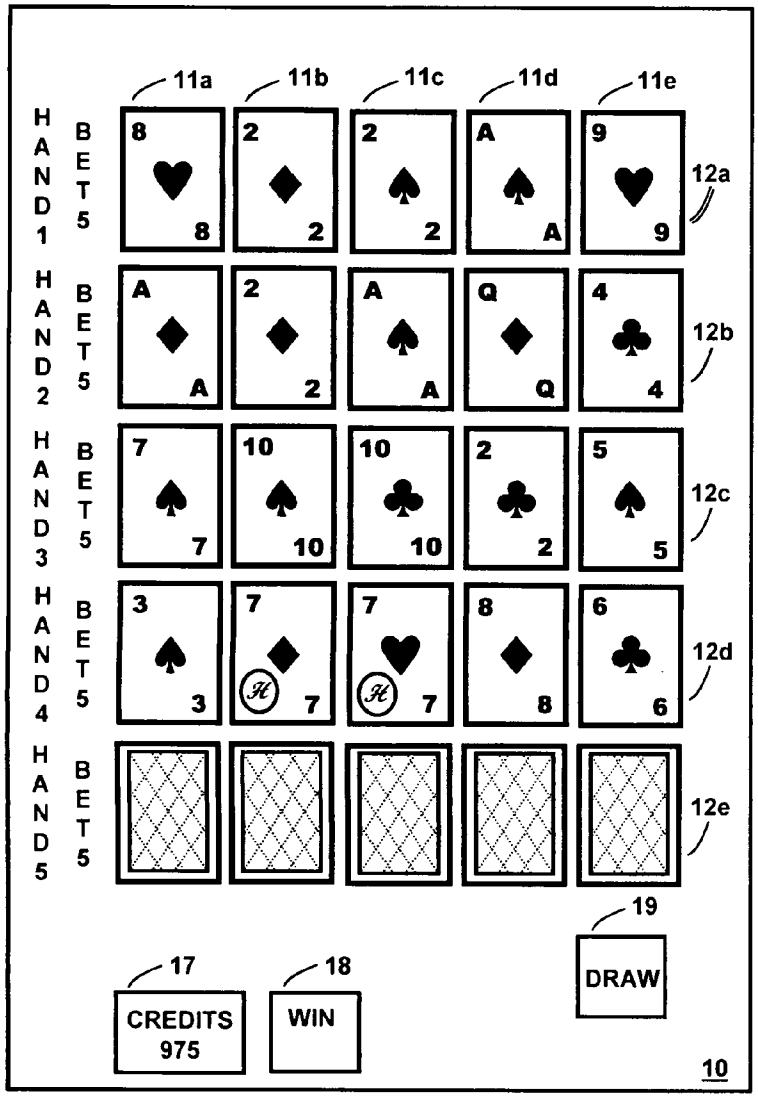
FIG. 11 shows a fourth hand of the five hands of cards dealt during the round of game play of the alternative embodiment of the invention in which the non-held cards from the third hand are carried forward to the fourth hand of cards, the non-held cards that were in the third hand are replaced to achieve the final hand of cards for the third hand, and cards in the fourth hand are held or rejected.

After the cards in Hand 3 are selected to be held the player touches Draw button 19. Responsive thereto Hand 4 cards are dealt and the game video display is as shown in FIG. 11. In accordance with the teaching of the alternative embodiment of the invention the non-held cards in Hand 3, the three of spades, two of clubs and five of spades slide down and are displayed in the same relative positions in Hand 4. Two new cards, the seven of diamonds and seven of hearts, are drawn and displayed in the second and third positions of Hand 4 as shown in FIG. 11. With the three non-held cards moving from Hand 3 to Hand 4 they must be replaced in Hand 3. The seven of spades replaces the three of spades, the two of clubs replaces the eight of diamonds and the five of spades replaces the six of clubs. The held cards in Hand 3, the ten of spades and the ten of clubs remain in the second and third positions in Hand 3 as shown in FIG. 11. This is the final set of cards for Hand 3 and they are displayed as Hand 3 in FIGS. 10 through 12. This final Hand 3, which comprises the seven of spades, ten of spades, ten of clubs, two of clubs and five of spades will be evaluated for any winnings at the end of the round of game play.

The newly dealt cards in Hand 4 are the seven of diamonds and seven of hearts. The player must now select what cards in Hand 4, if any, are to be held. As shown in FIG. 11 the player has elected to hold the seven of diamonds and seven of hearts and touches these two cards. As the player touches each of these two cards the letter "*H*" in a circle is displayed on each card indicating it is being held.

After the cards in Hand 4 are selected to be held the player again touches Draw button 19. Responsive thereto Hand 5 cards are dealt and the game video display is as shown in FIG. 12. It should be noted that the non-held cards from Hand 4 in Hand 5, the three of spades, eight of diamonds and six of clubs were moved down and are displayed in the same relative positions in Hand 5. Two new cards, the queen of hearts and the jack of spades are drawn and displayed in the second and third positions of Hand 5 as shown. With the three non-held cards moving from Hand 4 to Hand 5 they must be replaced in Hand 4. The king of diamonds replaces the three of spades, the nine of spades replaces the eight of diamonds and the nine of diamonds replaces the six of clubs. The non-held card in Hand 4, the seven of diamonds and seven of hearts, remain in Hand 4 as shown. This is the final set of cards for Hand 4 and it is displayed as Hand 2 in FIG. 12. This final Hand 4, with comprises the king of diamonds, seven of diamonds, seven of hearts, nine of spades and nine of diamonds will be evaluated for any winnings at the end of the round of game play.

The newly dealt cards in Hand 5 are the queen of hearts and jack of spades. The player does not select any cards in Hand 5 to be held because there is no Hand 6. Thus, the five cards shown in Hand 5 in FIG. 12, which comprises the three of spades, queen of hearts, jack of spades, eight of diamonds and six of clubs up are the final set of cards for Hand 5.

With the play of all five hands of the round of game play being completed, the game program determines the winning hands of the five hands. As may be seen in FIG. 12 Hand 2 has a pair of aces which is jacks are better and, per the pay table in FIG. 2, yields one credit for each bet. Hand 4 has two pair, a pair of sevens and a pair of nines which, per the pay table in FIG. 2, yields two credits for each bet. These winning hands are indicated at the bottom video display screen 10 along with the player's winnings. The player placed five bets on each hand so the player wins five credits on Hand 2 and wins ten credits on Hand 4. Thus, the player wins a total of 15 credits as indicated in Win display area 18. In the Credits display area 17 the player's 975 credits is incremented by the 15 credits won by the player to a new total of 990 credits as shown.

While what has been described hereinabove are several examples of the Cascade Draw Poker game play per the preferred embodiment of the invention and one alternative embodiment, it should be understood that numerous changes maybe made without departing from the spirit and scope of the invention. For example, while five hands of cards are disclosed hereinabove for a round of game play, fewer or more hands of cards may be used in a round of game play. In addition, in the last hand of cards the player may select cards to be held and non-held cards are replaced, while non-held cards are discarded.

What is claimed is:

1. A method of playing a round of a draw poker game on a computer-controlled video display, the method comprising:

displaying a first hand of cards face up on said computer-controlled video display, the first hand of cards consisting of a first predetermined number of cards;

removing cards from the first hand of cards, said removed cards from the first hand of cards being in number from zero to said first predetermined number of cards;

in response to receiving a first card removal request for said first hand of cards, adding to the first hand of cards a replacement card for each card removed from the first hand of cards, wherein said replacement card for each card removed from the first hand of cards is displayed by said computer-controlled video display face up, along with any remaining additional drawn cards in said first hand to obtain a final first hand of cards;

displaying a second hand of cards face up on said computer-controlled video display, wherein the second hand of cards includes all the cards removed from the first hand of cards, and wherein the second hand of cards consists of a second predetermined number of cards;

removing cards from the second hand of cards, said removed cards from the second hand of cards being in number from zero to said second predetermined number of cards;

in response to receiving a second card removal request for said second hand of cards, adding to the second hand of cards a replacement card for each card removed from the second hand of cards, wherein said replacement card for each card removed from the second hand of cards is displayed by said computer-controlled video display face up, along with any remaining additional drawn cards in said second hand to obtain a final second hand of cards; and displaying a third hand of cards face up on said computer-controlled video display, wherein the third hand of cards consists of a third predetermined number of cards, and wherein the third hand of cards includes all the cards removed from the second hand of cards and any remaining additional drawn cards in said third hand to obtain a final third hand of cards;

wherein said replacement card for each card removed from said first, second, or third hand of cards is previously undrawn within said round of game play until said replacement card is first displayed in its original replacement position by said computer-controlled video display.

2. The meted of claim 1, wherein first, second, and third decks of cards are used in dealing and providing replacement cards for, respectively, the first, second, and third hands of cards.

3. The method of claim 1, wherein the first, second, and third predetermined number of cards are the same number.

* * * * *